United States Patent [19]

Ikegami

[11] Patent Number: 4,919,216

[45] Date of Patent: Apr. 24, 1990

[54] AUTOMATIC IMPACT DRIVER

[76] Inventor: Kazunori Ikegami, 6-30, Minami-Honmachi 5-chome, Yao-shi, Osaka, Japan

[21] Appl. No.: 354,555

[22] Filed: May 22, 1989

[30] Foreign Application Priority Data

Mar. 2, 1989 [JP] Japan ..... 64-151433

[51] Int. Cl.[5] ..... B25B 21/02

[52] U.S. Cl. ..... 173/93.6; 173/119; 173/124

[58] Field of Search ..... 173/119, 93–93.7, 173/124

[56] References Cited

U.S. PATENT DOCUMENTS 2,960,864 11/1960 Watts ..... 173/119
3,054,312 9/1962 Zengerer ..... 173/93.7
3,135,147 6/1964 Curtis et al. ..... 173/119
3,177,952 4/1965 West ..... 173/124

*Primary Examiner*—Frank T. Yost
*Assistant Examiner*—Rinaldi Rada
*Attorney, Agent, or Firm*—Armstrong, Nikaido, Marmelstein, Kubovcik & Murray

[57] ABSTRACT

An automatic impact driver for applying a large torque to a tip chuck by only pressing down a casing so as to remove corroded screws etc. A cylindrical slider freely movable in an axial direction is disposed in the casing, a cam mechanism is installed in between the slider and the chuck, and the chuck is turned by applying an impact force on a plunger through the slider. Since the impact driver is constructed as described above, a loss of impact transmitting force is decreased as compared with a conventional structure in which the slider is directly struck by the casing.

2 Claims, 7 Drawing Sheets

FIG. 9
FIG. 8
FIG. 10
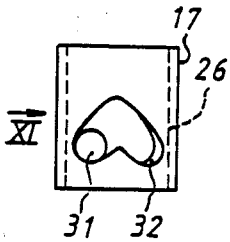
FIG. 11
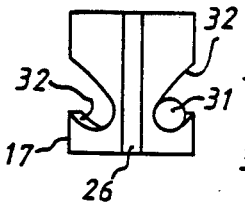
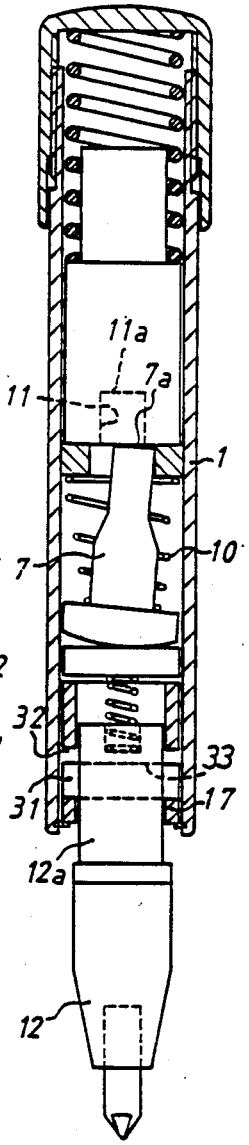
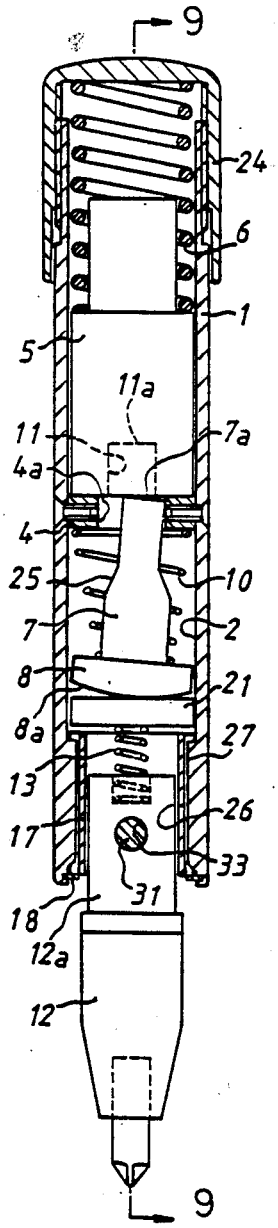

AUTOMATIC IMPACT DRIVER

BACKGROUND OF THE INVENTION

1. Technical field

This invention relates to an impact driver which is used for loosening screws and nuts corroded with rust to cause difficulty in loosening by utilizing shocks, or for tightening screws etc. securely in a final stage.

2. Prior art

In a screw fastening structure, it sometimes occurs that a screw sticks to its fitting member or a nut due to rust with an elapse of time, and the screw can not be removed by an ordinary driver or spanner in such a case.

To cope with this kind of trouble, the screw is removed by using a chisel or a gas cutting device when the screw or screw hole can be broken, but it is removed by applying shocks on a driver head using a hammer when the screw hole or screw fitting member is to be utilized again.

In recent years, an impact driver is proposed whereby a screw can be removed without being broken not only by applying shocks on its head but by converting a shock of hammer into a twisting torque utilizing a cam mechanism to make a bit of the driver generate an instantaneous large torque.

Namely, in this impact driver; a chuck is fitted rotatably in a cylindrical casing, a cam mechanism for converting an axial movement of the casing into a rotational movement of the chuck is installed between the casing and the chuck, and the bit of the chuck is turned with an instantaneous large torque applied on a top wall of the casing with a hammer by an operator.

However, since the operator strikes the top wall with the driver in one hand and the hammer in the other, the operator sometimes damages the fitting member or strikes his finger due to faulty aim.

Further, a large torque loss will be produced because the operator strikes the entire casing having a large mass and the shock is transmitted from the casing throug the cam mechanism to the chuck.

OBJECT OF THE INVENTION

An object of the invention is to provide an impact driver which requires no hammer, can produce a large impact force in a simple manner by only pressing a casing, can give a large instantaneous torque to a chuck, and develops a good transmission efficiency of impact force to the chuck.

SUMMERY OF THE INVENTION

In order to accompish the above object of the invention, a hammer block urged toward an opening of a casing by an impacting coil spring is fitted in the cylindrical casing in such a manner as to be movable freely in an axial direction,a cylindrical slider stopped its rotary motion by a whirl-stop or rotation preventing mechanism is fitted in an inner peripheral surface of the opening side of the casing in such a manner as to be movable freely in the axial direction, said cylindrical slider being secured by a fastening member so as not to slip off, a chuck for gripping a bit is fitted in an inner peripheral surface of the slider in such a manner as to be rotatable and movable in the axial direction, a cam mechanism for converting an axial motion of the slider into a rotary motion of the chuck is installed between the slider and the chuck, a plunger for transmitting an impact of the hammer block to the slider is disposed between the slider and the hammer block in such a manner as to be freely movable in the axial direction, a recessed part in which the plunger is fittable is formed on a hammer block surface fronting on the plunger, a prescribed stroke is secured by a holding mechanism between a plunger top wall of the hammer block and an impact face at the bottom of a recessed part fronting thereon, and a releasing mechanism is provided which releases said holding mechanism when the casing moves relatively to the plunger and compresses the impacting spring by a specified amount with said stroke maintained at the above state.

When a bit at the tip end of a screw driver is fitted into a screw head (or onto a nut) to press the casing toward the opening in the axial direction, the casing first moves relatively to the hammer block, the plunger and the chuck while the holding mechanism is working, thereby the impacting coil spring being compressed to conserse an energy.

When pressing amount of the casing reaches the specified value, the releasing mechanism works automatically to release the holding state maintained by said holding mechanism. Then, the impacting coil spring stretches instantaneously to push the hammer block toward the opening side to cause the recessed impacting surface of the hammer block to strike against the plunger top wall, so that an impact force is transmitted directly from the plunger to the slider. The impact force is converted to the rotary motion of the chuck through the cam mechanism, so that the chuck produces a large instantaneous torque and the screw can be loosened by this torque and said impact force.

BRIEF DESCRIPTION OF THE DRAWINGS

FIG. 8 is a vertical sectional view of a second embodiment.

FIG. 9 is a sectional view taken on a line 9—9 of FIG. 8.

FIG. 10 is a front view of a slider installed in the driver.

FIG. 11 is a view viewed in a direction of arrow 11 of FIG. 10.

DETAILED DESCRIPTION OF THE INVENTION

Embodiment 1

Figure 1:
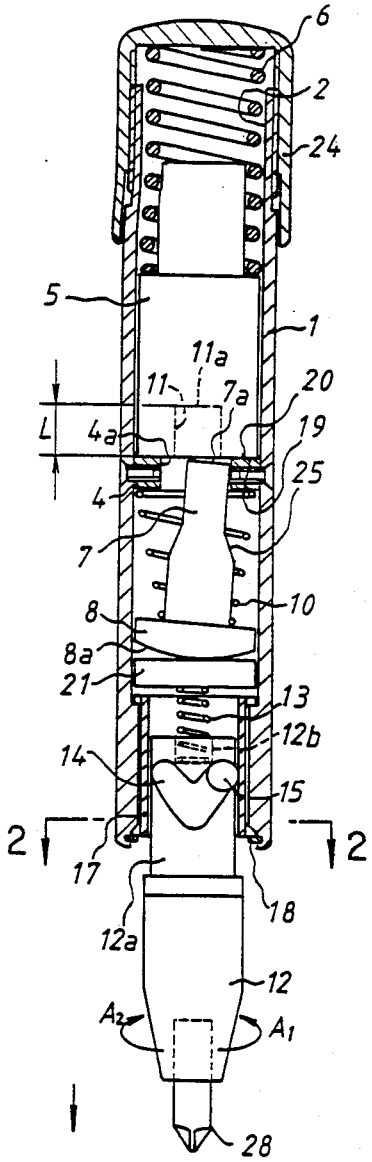
FIG. 1 is a vertical sectional view of an impact driver of a first embodiment (taken on a line 1—1 of FIG. 2).
Figure 2:
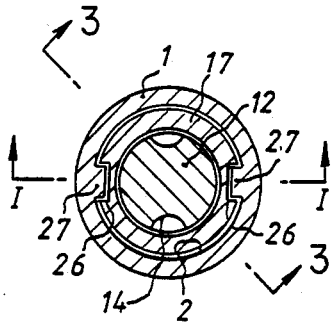
FIG. 2 is a sectional view taken on a line 2—2 of FIG. 1.
Figure 3:
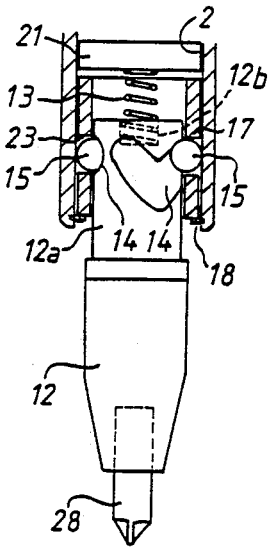
FIG. 3 is a sectional view taken on a line 3—3 of FIG. 2.

FIG. 1 through FIG. 3 illustrate the first embodiment of the present invention and FIG. 4 through FIG. 7 illustrate sequential working states of the embodiment, in which an opening side (bit attaching side) of a casing 1 is positioned downward for convenience sake. In FIG. 1, the cylindrical casing 1 is long in its vertical direction, a bottomed cylindrical cap 24 is screwed onto a top end thereof, an inward neck 4 is secured to a casing inner peripheral surface 2 at its axial (vertical) central part, and a bottom part of the casing 1 is opened. An inner peripheral edge 4*a* of the neck 4 together with a tapered cam surface 25 of a plunger 7 described later compose a releasing mechanism. A hammer block 5 having a circular section fits in an upper part of the neck 4 in such a manner as to be movable in an axial direction, and the hammer block 5 is formed into a large-dia. portion at its lower half and a small-dia. portion at its upper half through an annular shouldered surface. An impacting coil spring 6 having a large spring rigidity is compressively installed between the annular shouldered surface of the hammer block 5 and a top wall of the cap 24, thereby a bottom surface 20 of the hammer block 5 being made to contact with the neck 4. A recessed part 11 extending upwardly is formed at a bottom central part of the hammer block 5, the recessed part 11 is formed into a circular sectional shape and its depth L provides a stroke for releasing motion of the hammer block 5.

The plunger 7 is fitted in a lower part of the neck 4, an upper half portion of said plunger 7 has a diameter fittable in said recessed part 11, the tapered cam surface 25 for the releasing mechsnism is formed at its central portion, and this tapered cam surface 25 expands in its diameter as it goes downward. The outside diameter of the plunger 7 has a diameter fittable in the inner peripheral edge 4*a* of the neck 4. A cylindrical flat end base 8 is formed integrally with the plunger 7 at it bottom part, a bottom surface 8a of the end base 8 is formed into a partially spherical shape, and an outer peripheral surface of the end base 8 has a clearance in relation to the inner peripheral surface 2 to such an extent that the plunger 7 can incline as illustrated by FIG. 1.

An eccentric coil spring 10 decreasing its diameter dowawardly is fitted onto an outer periphery of the plunger 7, and the plunger 7 is kept at an inclining state by said coil spring 10. Thereby, a plunger top wall 7*a* is biassed from said recessed part 11 in a radial direction, and the top wall 7*a* is made to contact with the hammer-block bottom surface 20 so as to compose the holding mechanism.

A spacer 21 contacting with the plunger end base 8 is fitted in a lower side thereof in such a manner as to be movable in the axial direction, and a cylindrical slider 17 is fitted in a further lower side thereof freely movably in the axial direction. A pair of vertical grooves 26 are formed on an outer peripheral end of the slider 17 to prevent rotation as illustrated by FIG. 2. The vertical grooves 26 fit onto a pair of inward vein-like projections 27 formed on the casing inner peripheral surface 2, whereby rotation of the slider 17 is stopped.

In FIG. 3 showing the section taken on the line 3—3 of FIG. 2, a snap ring 18 is fixed to the lowermmost part of the casing inner peripheral surface 2, thereby preventing the slider 17 from slipping off downwardly.

A shank 12*a* of the chuck 12 is fitted in an inner peripheral surface of the slider 17 in such a manner as to be rotatable in relation to the slider 17 and movable in the axial direction, and a cross bit 28 for example is gripped by a bottom end of the chuck 12. The bit 28 is exchangeable with respect to the chuck 12, and the chuck 12 is also exchangeable with respect to the shank 12*a*. The bit 28 is exchangeable to those of cross-type, minus-type and hexagon-shaft type of various sizes, and the chuck 12 itself is exchangeable to that having a polygon socket etc.

In order to convert the axial motion of the slider 17 into a the rotary motion of the chuck 12, a cam mechanism comprising a pair of cam grooves 14 and a pair of steel balls 15 etc. is provided between the shank 12*a* of the chuck 12 and the slider 17. A pair of ball holding holes 23 are formed on the slider 17 at places facing each other, balls fit rotatably in respective ball holding holes 23, and the balls protrude inwardly in a radial direction. The cam groove 14 is formed on an outer peripheral surface of the chuck shank 12*a* into a V-shape (or heart-shape) which opens in an upward direction, and a part of said ball 15 fits rotatably in the cam groove 15. A return coil spring 13 is compressively installed between an upper end recessed part 12*b* of the chuck shank 12*a* and the spacer 21, and the chuck 12 is pressed downward by said return coil spring 13, thereby the ball 15 being held at an upper end waiting position of the cam groove 14.

Function of the device will be described hereunder. FIG. 1 shows a state before working; and in which the hammer block 5 is contacted against an upper surface of the neck 4 by means of the impacting coil spring 6, the plunger 7 is inclined by the eccentric coil spring 10, the plunger top wall 7*a* deviates with respect to the recessed part 11, and a peripheral wall of the upper half of the plunger 7 is contacted with the inner peripheral edge 4*a* of the neck 4. The chuck 12 and the slider 17 are urged downward by the return coil spring 13 so that a lower end of the slider 17 contacts with the snap ring 18 and the ball 15 is located at the upper end waiting position of the cam groove 14. Under this state, the tip bit 28 is fitted in a groove of a screw head for example, and the cap 24 is pressed strongly downward by hand.

Figure 4:
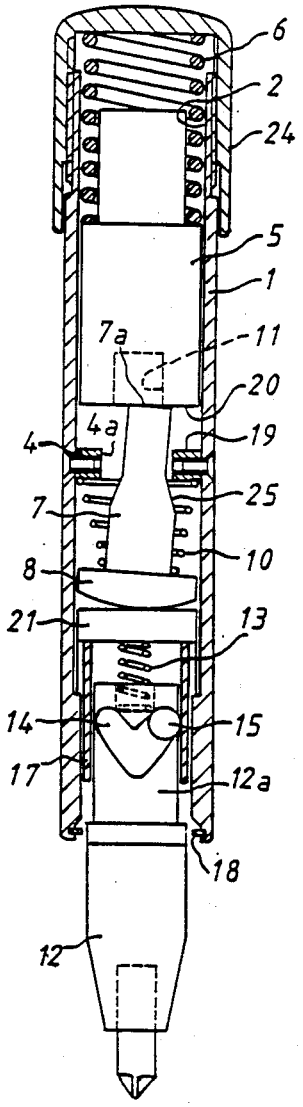

Then, as illustrated by FIG. 4, the casing 1 moves down to compress the return coil spring 13 in the first stage to cause the spacer 21 to contact with the upper end of the slider 17, and the chuck 12 begins to be housed in the casing 1 in the next stage. Simultaneously with this motion, the eccentric coil spring 10 begins to be compressed and the plunger top wall 7*a* contacts with and holds against the bottom surface 20 of the hammer block 5 so that the impacting coil spring 6 is compressed in between the hammer block 5 and the cap 24.

Figure 5:
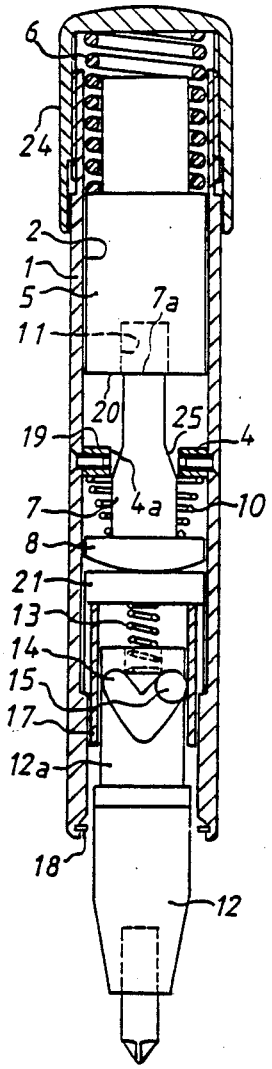
FIG. 4 through FIG. 7 are vertical sectional views showing working states of the driver of FIG. 1, respectively.

In FIG. 5, when the compression amount of the impacting coil spring 6 gradually increases to cause the tapered cam surface 25 of the plunger contact with the inner peripheral edge 4*a* of the neck 4, that contact causes a releasing function to start working so that the plunger 7 gradually changes its position from the inclined state to an upright state where the top wall 7*a* fronts on the recessed part 11.

Figure 6:
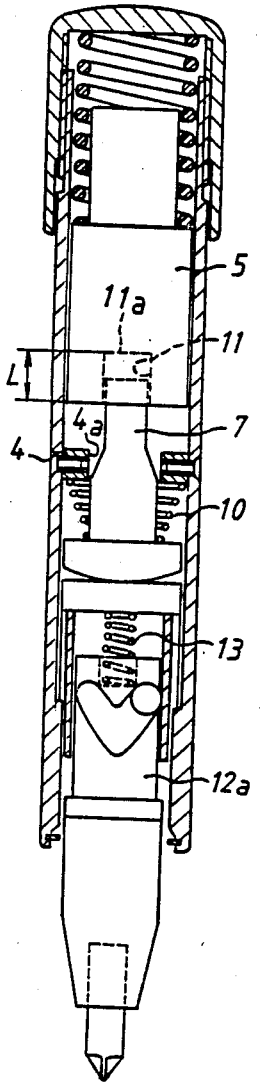

The moment the plunger 7*a* comes to a position fronting on the recessed part 11, the impacting coil spring 6 having been compressed up to now stretches (springs back) instantaneously, as illustrated by FIG. 6, to cause the hammer block 5 move downward instantaneously by the stroke L so as to give the impact force on the plunger top wall 7*a* through means of the impacting surface 11*a* of the recessed part 11.

Figure 7:
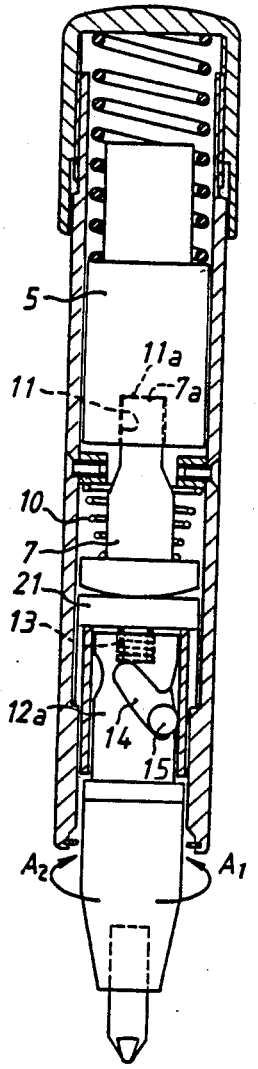

Said impact force is transmitted directly to the slider 17 through the plunger 7 and the spacer 21, so as to make the slider 17 move downward instantaneously, as illustrated by FIG. 7. The ball 15 also moves downward together with the slider, and the chuck 12 is turned in a direction of arrow A within a small turning range by means of a cam action generated by the cam groove 14 and the ball, so that a screw can be loosened.

One depression allows the ball 15 to move to a bottom part of the cam groove 14.

When the prssing force on the casing 1 is removed, the driver is returned to the state of FIG. 1 by restoring forces of the return spring 13 and the eccentric coil spring 10, and the ball 15 is returned to an uppermost waiting position of the cam groove 14.

The foregoing action is an action for turning the chuck 12 in a direction of arrow A1 (counterclockwise) in order to loosen a right-handed screw for example. However, in case of tightening a screw securely or loosening a left-handed screw, the chuck 12 is turned in the direction of arrow A1 from the state of FIG. 1 in advance of the pressing action, so that the ball 15 can be located at the other uppermost waiting position of the cam groove 14, i.e. at a left side uppermost position thereof. Thereby, the chuck 12 can be turned in a direction of A2 when the casing is pressed downward.

Embodiment 2

Embodiments shown in FIG. 8 through FIG. 11 are so constructed that a pin 31 and a cam groove 32 are used for the cam mechanism in between the slider 17 and the chuck 12. As illustrated in FIG. 9, a pin hole 33 perpendicular to the axial direction is formed in the chuck shank 12*a* and the pin 31 is inserted in this hole in such a manner that both ends of the pin protrude to both sides. On the other hand, a pair of inverted V-shape cam grooves 32 fronting each other are formed on the slider 17 as illustrated by FIG. 10 and FIG. 11, and the both protruding portions of the pin 31 are fitted in respective cam grooves 32. Another conctructions are the same as those of said Embodiment 1 and the same components are annexed with the same part numbers.

Since the cam grooves 32 are formed on the slider 17 side in this embodiment, lowermost ends of the cam grooves 32 form the waiting position and the pin 31 is therefore located at the lowermost end of the cam groove 31 in advance of the pressing action as shown in FIG. 10.

Embodiment 3

Figure 13:
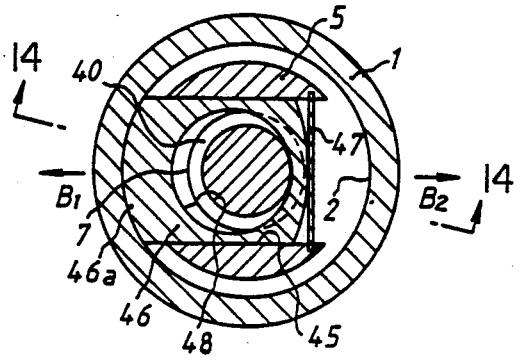
FIG. 13 is a sectional view taken on a line 13—13 of FIG. 12.
Figure 12:
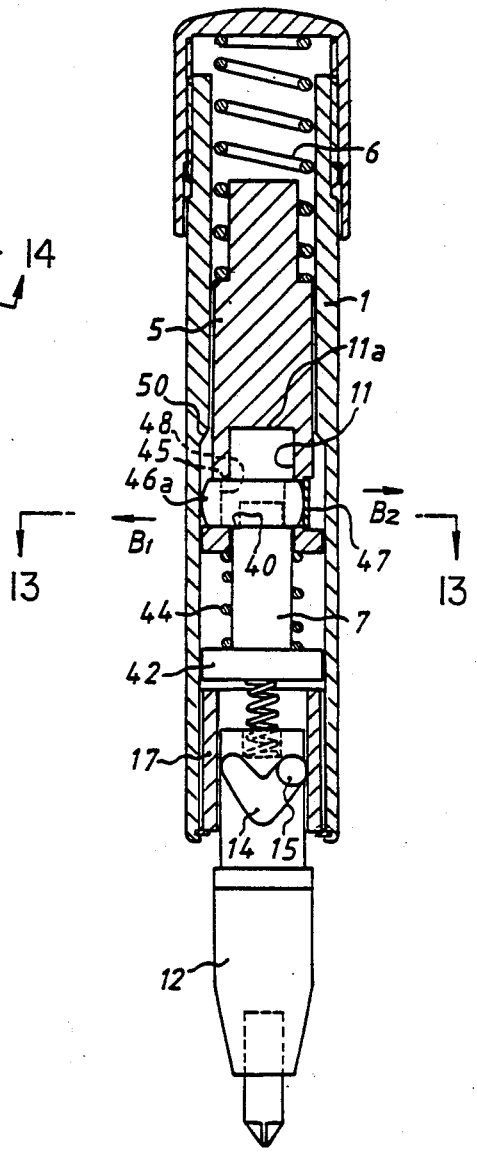
FIG. 12 is a vertical sectional view of a third embodiment.
Figure 14:
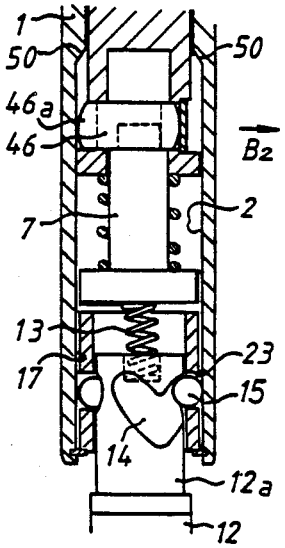
FIG. 14 is a sectional view take non a line 14—14 of FIG. 13.

FIG. 12 through FIG. 14 show an alternate embodiment for the holding mechanism and the releasing mechanism. In FIG. 12, a small-dia. portion is formed on the plunger 7 at its top end through an annular shouldered surface 40, an enlarged base portion 42 is formed at its bottom end,and a bottom surface of said enlarged base portion 42 is formed into a flat face so as to directly contact with a top end face of the slider 17. An ordinary cylindrical coil spring 44 is compressively installed between the plunger base portion 42 and the bottom surface of the hammer block 5, and the plunger 7 is always kept at a coaxial position with the recessed part 11. A guide hole 45 intersecting the recessed part perpendicularly to the axial direction is formed in the recessed part 11 of the hammer block 5, and a trigger member 46 is inserted in said guide hole 45 in such a manner as to movable freely in a direction perpendicular to the axial direction.

In FIG. 13, a hole 48 piercing through the member vertically and having a bore in which the body of the plunger 7 can fit is formed in the trigger member 46, and the trigger member 46 is urged to an arrow B1 side by an elastic force of a leaf spring 47 disposed at an end of the member. By the elastic force of the leaf spring 47, the trigger member 46 is made to contact with the casing inner peripheral surface 2 at its contacting portion 46a and at the same time the hole 48 is kept at a position deviated from the plunger 7 in the direction of arrow B1, so that a part of the annular shouldered surface 40 of the plunger 7 catches on the trigger member 46 to maintain the holding state.

Figure 16:
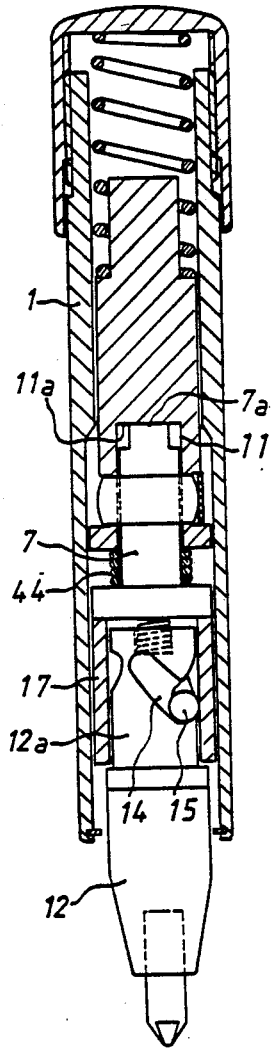
FIG. 15 and FIG. 16 are vertical sectional views showing working states of the driver of FIG. 12.
Figure 15:
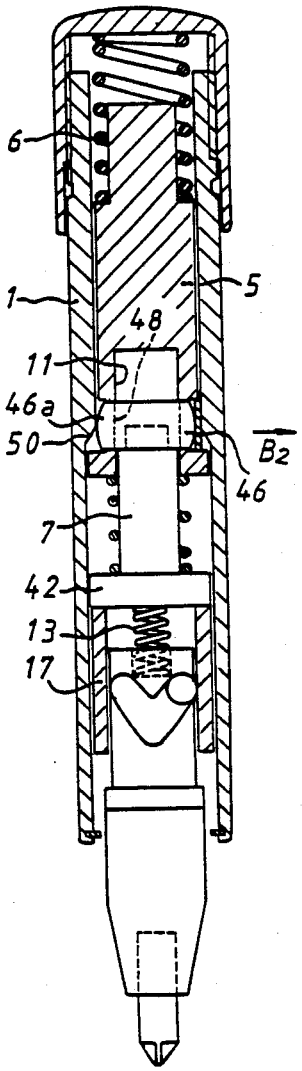

On the other hand, a tapered cam surface 50 is formed on the inner peripheral surface 2 of the casing 1 at a position separated upwardly by a specified length from the trigger member 46 as illustrated by FIG. 14. When the tapered cam surface 50 contacts with a contacting part 46*a* of the trigger member 46, the trigger member 46 is pushed in the direction of arrow B2 to release the holding state. Namely, in this embodiment, when the casing 1 is pressed down, the annular shouldered surface 40 of the plunger 7 catches on the trigger member 46 to maintain the holding state so that the impacting coil spring 6 is compressed first, as shown by FIG. 12. Then, when the contacting part 46 of the trigger member 46 contacts with the tapered cam surface 50 as illustrated by FIG. 15, the trigger member 46 is pushed in the direction of arrow B2. At the moment where the hole 48 of the trigger member 46 is aligned with the recessed part 11, the hammer block 5 moves downward instantaneously to cause the striking surface 11*a* of the recessed part 11 to strongly strike the top wall 7*a* of the plunger 7 as illustrated by FIG. 16.

Incidentally, other structures are the same as those of the foregoing Embodiment 1 and the same components are annexed with the same part numbers.

Other Embodiments

Figure 17:
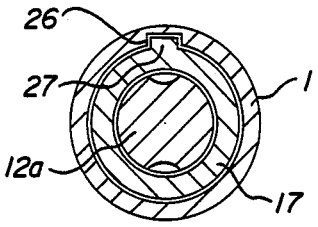
FIG. 17 through FIG. 21 are sectional views showing alternate embodiments of slider locking mechanism.

FIG. 17 through FIG. 21 show alternate examples of the rotation prevention mechanisms for the slider. FIG. 17 shows an example, in which one vein-shape projection 27 is formed on the slider 17 and one vein-shape vertical groove is formed on the inner peripheral surface of the casing 1.

Figure 18:
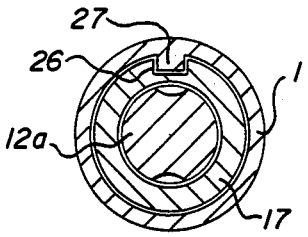

FIG. 18 shows an example, in which one vein-shape vertical groove 26 is formed on the slider 17 and one vein-shape projection 27 is formed on the inner peripheral surface of the casing 1.

Figure 19:
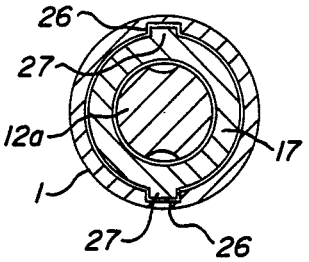

FIG. 19 shows an example, in which a pair of vein-shape projections 27 fronting each other are formed on the slider 17 and a pair of vein-shape vertical grooves 26 fronting each other are formed on the inner peripheral surface of the casing 1.

Figure 20:
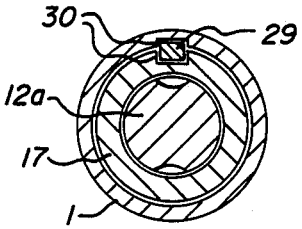

FIG. 20 shows an example, in which one vertical key way 30 is formed on the slider 17 and the casing 1 respectively, and a key 29 is inserted in said key way 30.

Figure 21:
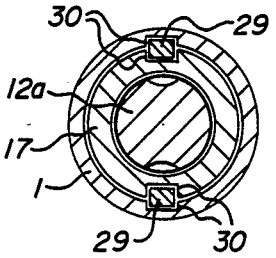

FIG. 21 shows an example, in which a pair of key ways 30 are formed on the slider 17 and the casing 1 respectively, and keys 29 are inserted in respective key ways 30.

Effect of the Invention

As explained in the foregoing description, the following advantages become obtainable according to the present invention:

(1) By only pressing the casing 1 downward, the energy is conserved in the impacting coil spring 6 and at the same time the impact force is generated instantaneously to give the large turning torque to the chuck 12 automatically, so that the work for removing screws etc. corroded with rust can be carried out safely and easily.

Namely, as compared with the conventional structure wherein the casing is struck by a hammer, such troubles can be avoided that the fitting members are damaged or fingers are struck due to faulty striking of the hammer.

(2) The impact force generated by the hammer block 5 in the casing 1 is transmitted not through the casing 1 but directly to the slider 17 which is a small member, and from the slider 17 through the cam mechanism to the chuck 12 as the turning torque. Accordingly, a loss of impact transmitting force in the impact transmitting route is small as compared with the conventional structure wherein the impact force is transmitted from the casing through the cam mechanism to the chuck.

What is claimed is:

1. An automatic impact driver comprising:

a cylindrical casing open at one end and closed at the other end by a cylindrical cap;

a hammer block fitted in said casing so as to be freely movable in an axial direction;

a coil spring fitted in said casing between said hammer block and said cylindrical cap so as to urge said hammer block toward said open end;

a cylindrical slider fitted in an inner peripheral surface of said casing at the open end thereof so as to be freely movable in an axial direction, said casing including rotation prevention means for preventing rotation of said slider in said casing and means for retaining said slider within said casing;

a chuck for gripping a bit fitted in an inner peripheral surface of said slider so as to be rotatable and moveable in an axial direction therein;

a cam mechanism installed between said chuck and said slider for converting axial motion of said slider relative to said chuck into rotary motion of the chuck;

a plunger disposed between said slider and said hammer block and movable in the axial direction for transmitting an impact of said hammer block to said slider;

a recessed part including a hammer face formed in a surface of said hammer block fronting on a top wall of said plunger, which top wall is formed to fit into said recessed part;

a holding mechanism between said plunger top wall and said hammer block to prevent said top wall from entering said recessed part as said casing is urged toward said hammer block to compress said coil spring thereagainst; and a releasing mechanism for releasing said holding mechanism when the casing has moved relative to said hammer block and said plunger so as to compress said coil spring, such that said hammer block urged by said coil spring is released to impact said plunger top wall with said hammer face, said impact causing said slider to be moved axially whereby said chuck and bit are caused to rotate by said cam mechanism;

wherein a V-shaped cam groove is formed on an outer peripheral surface of the chuck, a ball holding hole is formed in the slider, a ball held rotatably in said ball holding hole is fitted in the cam groove so as to compose the cam mechanism, an eccentric coil spring is fitted onto an outer peripheral surface of the plunger so as to compose the holding mechanism, a top wall of the plunger is made to contact with a bottom face of the hammer block by said eccentric coil spring so that a holding state is created, a tapered cam surface increasing in its diameter downwardly is formed on an intermediate portion of an outer peripheral surface of the plunger, a neck for guiding said tapered cam surface is formed on an inner peripheral surface of the casing so as to compose the releasing mechanism, and the tapered cam surface is guided by an inner peripheral face of the neck as the plunger comes up within said neck so that the plunger top wall is fitted in the recessed part of the hammer block.

2. An automatic impact driver comprising:

a cylindrical casing open at one end and closed at the other end by a cylindrical cap;

a hammer block fitted in said casing so as to be freely movable in an axial direction;

a coil spring fitted in said casing between said hammer block and said cylindrical cap so as to urge said hammer block toward said open end;

a cylindrical slider fitted in an inner peripheral surface of said casing at the open end thereof so as to be freely movable in an axial direction, said casing including rotation prevention means for preventing rotation of said slider in said casing and means for retaining said slider within said casing;

a chuck for gripping a bit fitted in an inner peripheral surface of said slider so as to be rotatable and moveable in an axial direction therein;

a cam mechanism installed between said chuck and said slider for converting axial motion of said slider relative to said chuck into rotary motion of the chuck;

a plunger disposed between said slider and said hammer block and movable in the axial direction for transmitting an impact of said hammer block to said slider;

a recessed part including a hammer face formed in a surface of said hammer block fronting on a top wall of said plunger, which top wall is formed to fit into said recessed part;

a holding mechanism between said plunger top wall and said hammer block to prevent said top wall from entering said recessed part as said casing is urged toward said hammer block to compress said coil spring thereagainst; and a releasing mechanism for releasing said holding mechanism when the casing has moved relative to said hammer block and said plunger so as to compress said coil spring, such that said hammer block urged by said coil spring is released to impact said plunger top wall with said hammer face, said impact causing said slider to be moved axially whereby said chuck and bit are caused to rotate by said cam mechanism;

wherein a cam pin protruding toward both sides is secured to the chuck, inverted V-shaped cam grooves are formed on the slider, ends of the cam pin are fitted in the cam grooves so as to compose the cam mechanism, an eccentric coil spring is fitted onto an outer peripheral surface of the plunger so as to compose the holding mechanism, a top wall of the plunger is made to contact with a bottom face of the hammer block by said eccentric coil spring so that a holding state is created, a tapered cam surface increasing in its diameter downwardly is formed on an intermediate portion of an outer peripheral surface of the plunger, a neck for guiding said tapered cam surface is formed on an inner peripheral surface of the casing so as to compose the releasing mechanism, and the tapered cam surface is guided by an inner peripheral face of the neck as the plunger comes up within said neck so that the plunger top wall is fitted in the recessed part of the hammer block.

* * * * *

UNITED STATES PATENT AND TRADEMARK OFFICE

CERTIFICATE OF CORRECTION

PATENT NO. : 4,919,216

DATED : April 24, 1990

INVENTOR(S) : Kazunori IKEGAMI

It is certified that error appears in the above-identified patent and that said Letters Patent is hereby corrected as shown below:

On the cover page, Item [30], "64-151433" should read --1-51433--.

Signed and Sealed this

Seventeenth Day of March, 1992

*Attest:*

HARRY F. MANBECK, JR.

*Attesting Officer*

*Commissioner of Patents and Trademarks*